US005292382A

United States Patent [19]

Longo

[11] Patent Number: 5,292,382

[45] Date of Patent: Mar. 8, 1994

[54] MOLYBDENUM-IRON THERMAL SPRAYABLE ALLOY POWDERS

[75] Inventor: Frank N. Longo, East Northport, N.Y.

[73] Assignee: Sulzer Plasma Technik, Troy, Mich.

[21] Appl. No.: 755,376

[22] Filed: Sep. 5, 1991

[51] Int. Cl.[5] ..... C22C 30/00

[52] U.S. Cl. ..... 148/320; 148/325; 148/327; 148/334; 148/335; 148/423; 148/442; 420/10; 420/12; 420/43; 420/47; 420/57; 420/429; 420/586.1; 75/255

[58] Field of Search ..... 148/320, 325, 327, 334, 148/335, 423, 442; 420/10, 12, 47, 43, 52, 57, 67, 96, 100, 101, 105, 106, 108, 429, 583, 584.1, 588, 586.1; 75/255

[56] References Cited

U.S. PATENT DOCUMENTS

| | | | |
|---|---|---|---|
| 2,742,224 | 4/1956 | Burhans | 230/122 |
| 3,508,955 | 4/1970 | Sliney | 117/119 |
| 3,689,971 | 9/1972 | Davidson | 415/174 |
| 3,836,156 | 9/1974 | Dunthorne | 415/174 |
| 3,929,473 | 12/1975 | Streicher | 420/67 |
| 3,932,174 | 1/1976 | Streicher | 420/67 |
| 3,932,175 | 1/1976 | Streicher | 420/67 |
| 4,060,882 | 12/1977 | Pospisil et al. | 29/132 |
| 4,063,742 | 12/1977 | Watkins, Jr. | 415/174 |
| 4,127,410 | 11/1978 | Merrick et al. | 148/162 |
| 4,405,284 | 9/1983 | Albrecht et al. | 415/174 |
| 4,460,311 | 7/1984 | Trappmann et al. | 415/174 |
| 4,507,366 | 3/1985 | Werquin et al. | 428/682 |
| 4,526,509 | 7/1985 | Gay, Jr. et al. | 415/174 |
| 4,652,209 | 3/1987 | Buddenbohm | 415/174 |
| 4,664,973 | 5/1987 | Otfinowski et al. | 423/592 |
| 4,669,955 | 6/1987 | Pellow | 415/174 |
| 4,671,735 | 6/1987 | Rossmann et al. | 415/174 |
| 4,708,848 | 11/1987 | Lewis | 420/585 |
| 4,713,217 | 12/1987 | Stern | 420/442 |
| 4,725,508 | 2/1988 | Rangaswamy et al. | 75/255 |
| 4,810,464 | 3/1989 | Szereto et al. | 420/97 |
| 4,822,689 | 4/1989 | Fukubayashi et al. | 428/469 |
| 4,867,639 | 9/1989 | Strangman | 228/120 |

FOREIGN PATENT DOCUMENTS

| | | |
|---|---|---|
| 1004149 | 5/1989 | China . |
| 28213 | 5/1981 | European Pat. Off. . |
| 60-036601 | 2/1985 | Japan . |
| 61-000569 | 1/1986 | Japan . |
| 859472 | 8/1981 | U.S.S.R. . |

OTHER PUBLICATIONS

CA:109(18):154078n.

*Primary Examiner*—R. Dean
*Assistant Examiner*—Margery S. Phipps
*Attorney, Agent, or Firm*—Dykema Gossett

[57] ABSTRACT

An improved thermal sprayable molybdenum-iron alloy powder useful for forming wear and abrasion resistant coatings having high thermal conductivity and preferably good corrosion resistance. The preferred embodiment of the alloy powder includes two distinct substantially uniformly dispersed solid solution phases of molybdenum, including a first low molybdenum concentration matrix phase and a second higher molybdenum concentration phase for forming improved dual phase molybdenum coatings. The preferred alloy powder composition includes 15–60% by weight molybdenum, 20–60% by weight iron and the preferred corrosion resistant alloy includes 3–35% by weight nickel plus chromium. A more preferred composition includes by weight 25–50% molybdenum, 4–10% chromium, 10–18% nickel and 1–3% carbon, plus silicon as required to promote fluidity and atomization. The most preferred composition comprises by weight 25–40% molybdenum, 4 to 8% chromium, 12 to 18% nickel, 1–2.5% carbon, 2–3% silicon, 0.2–1% boron and 25–50% iron.

9 Claims, 3 Drawing Sheets

MOLYBDENUM-IRON THERMAL SPRAYABLE ALLOY POWDERS

BACKGROUND OF THE INVENTION

The present invention relates to improved thermal sprayable powders, particularly molybdenum-iron alloy powders suitable for forming improved coatings on metal substrates having high thermal conductivity and wear resistance. More particularly, the present invention relates to improved molybdenum-iron alloy powders suitable for thermal spraying and forming corrosion and wear resistant coatings having good thermal conductivity.

Surfaces subject to wear at elevated temperatures are often coated with metal alloys to reduce wear and to provide improved conductivity. For example, yankee dryer rolls used by the paper and pulp industries are often faced with a coating comprising 75% by weight molybdenum and 25% by weight nickel alloy. The coating is typically formed using a plasma spray gun into which is fed a blend of molybdenum and alloy powders. Yankee dryer rolls may exceed 20 feet in diameter and are often 30–40 feet in length. The molybdenum-nickel coatings are, however, susceptible to corrosion, reducing the useful life of such coatings, particularly in the corrosive environment to which yankee dryer rolls are subjected.

In such coatings, molybdenum provides improved wear resistance, high thermal conductivity and functions as a tribological couple with the doctor blade. These properties are critical in such applications, making molybdenum a preferred material for such coatings. Nickel alloy is added primarily to serve as a binder to hold the molybdenum particles together in the coating. Unfortunately, however, such nickel alloys have relatively poor thermal conductivity and when nickel is in contact with molybdenum under the service conditions of a yankee dryer rolls, galvanic potential exacerbates corrosion. As will be understood, corroded surfaces on yankee dryer rolls are unacceptable, requiring replacement or refacing, which is an expensive, time consuming procedure, particularly given the size of the rolls. A corrosion resistant coating is thus needed for such applications, which must also have good thermal conductivity and wear resistance.

As will be understood by those skilled in the art, there are many other applications requiring improved wear resistance and good thermal conductivity which do not necessarily require corrosion resistance. For example, there are numerous applications for coatings having improved wear resistance and good thermal conductivity in the automotive and aerospace industries. The coatings of this invention may be used for such applications as piston rings and shifter forks, for example.

Another problem with present wear resistant coatings requiring good thermal conductivity and wear resistance is the method of application. Where the constituents of the coating alloy must be fed as a blend of separate metal or metal alloy powders, the consistency of the resultant coating alloy may be adversely affected. Alloy thermal spray coating powders are, however, limited to alloys which may be formed by conventional atomization techniques. That is, the alloy formulation must be capable of being melted and atomized. Also, the alloy metal powder must be suitable for thermal spray applications, preferably suitable for both plasma and HVOF (high velocity oxygen flame) thermal spray apparatus. Thus, there is a need for a thermal sprayable metal alloy powder which may be used to form improved wear and abrasion resistant coatings having high thermal conductivity and most preferably coatings which are also corrosion and oxidation resistant. The improved thermal sprayable molybdenum-iron alloy powder of this invention meets these criteria.

SUMMARY OF THE INVENTION

The thermal sprayable powder of this invention is a molybdenum-iron alloy preferably having two distinct and dispersed solid solution phases of molybdenum, including a first low molybdenum concentration matrix phase and a preferably uniformly dispersed second higher molybdenum concentration phase, wherein the overall composition of the alloy (in both phases) comprises 15–60% by weight molybdenum, 20–60% by weight iron and 0–35% by weight nickel plus chromium and wherein the powder has an average particle size of less than about 80 mesh. Where the resultant coating preferably has high corrosion resistance, the combination of nickel plus chromium in the powder is 3–35% by weight, or more preferably 5–30% by weight of the total thermal sprayable powder composition. The more preferred embodiment of the thermal sprayable molybdenum-iron alloy powder of this invention comprises the following composition:

| Constituents | Wt. % |
|---|---|
| Mo | 20–55 |
| Cr | 3–20 |
| Ni | 2–20 |
| C | 0.5–3 |
| B | 0–2 |
| Ti | 0–2 |
| Mn | 0–3 |
| Si | 0–3 |
| Fe | 20–60 |

A more preferred composition of the thermal sprayable molybdenum-iron alloy powder of this invention is as follows:

| Constituents | Wt. % |
|---|---|
| Mo | 25–50 |
| Cr | 4–10 |
| Ni | 10–18 |
| C | 1–3 |
| B | 0–1 |
| Ti | 0–2 |
| Mn | 0–3 |
| Si | 1–3 |

wherein the balance is primarily iron (25–55%) and wherein silicon is added up to about 3% by weight to increase fluidity, which promotes atomization into the powder.

The most preferred composition of the thermal sprayable molybdenum-iron alloy of this invention for coating applications subject to abrasive wear and corrosive atmospheres is as follows:

| Constituents | Wt. % |
|---|---|
| Mo | 25–40 |
| Cr | 4–8 |
| Ni | 12–18 |
| C | 1–2.5 |
| Si | 2–3 |

-continued

| Constituents | Wt. % |
|---|---|
| B | 0.2-1 |

wherein the balance is primarily iron (about 25-50% by weight) and wherein the alloy can include additional constituents depending upon the application including, for example, titanium and manganese.

As described, the preferred thermal sprayable molybdenum-iron powder of this invention includes two distinct solid solution phases of molybdenum. One phase includes a high concentration of molybdenum, preferably at least about 40% by weight molybdenum, and the second phase, preferably forming the matrix, has a lower concentration of molybdenum, preferably less than about 20% by weight. In a most preferred embodiment, the concentration of molybdenum in the first phase is about 50-65% by weight, and the second matrix phase includes about 10-20% by weight molybdenum. Both phases preferably include a solid solution of molybdenum, chromium, nickel, carbon, silicon, boron and iron. The molybdenum-iron alloy may be thermal sprayed by conventional means, including plasma and HVOF apparatus. The resultant coating also preferably includes two distinct solid solution phases of molybdenum. The nature and composition of the phases in the sprayed coating will vary depending upon the spray parameters. Many of the two phase particles will be exposed to high temperatures, melt fully and quench harden during the spray process. These particles will generally form a solid solution of all of the constituents. Other particles of the powder will deposit on the substrate with the two phases of the powder intact, see discussion of FIG. 5 below. The relative concentrations and distribution of phases in the resultant coating can, however, be controlled by adjusting the heat energy transferred to the particles during spraying, particle size and the chemistry of the powder. The affect of the variations of the two phases on the coating, however, is not yet fully understood.

The resultant coating should exhibit excellent tribologica properties including wear and abrasion resistance and a high thermal conductivity. Further, when the coating includes chromium and nickel, the coating has good corrosion resistance and will provide an excellent coating for yankee dryer rolls and similar applications subject to corrosive environments. The coating may be applied to various substrates by conventional thermal spray techniques, including low and high carbon steels, stainless steel and the like.

Thus, the thermal sprayable alloy powder of this invention is relatively simple in composition, but creates a duplex coating alloy comprising high molybdenum phases distributed in a matrix. Prior to this invention, the only way to form a duplex coating alloy comprising molybdenum alloys was to start with a powder blend, one of which was the molybdenum alloy. Thus, the thermal sprayable alloy of this invention provides for duplex coating structures without the problems normally encountered when working with simple mechanical blends, including particle separation, poor distribution of particles, the tendency of such blends to form distinct layers and different deposit efficiencies for each powder in the blend, etc.

Other advantages and meritorious features of the present invention will be more fully understood from the following description of the preferred embodiments and figures illustrating this invention.

DESCRIPTION OF THE PREFERRED EMBODIMENTS OF THE INVENTION

Figure 1:
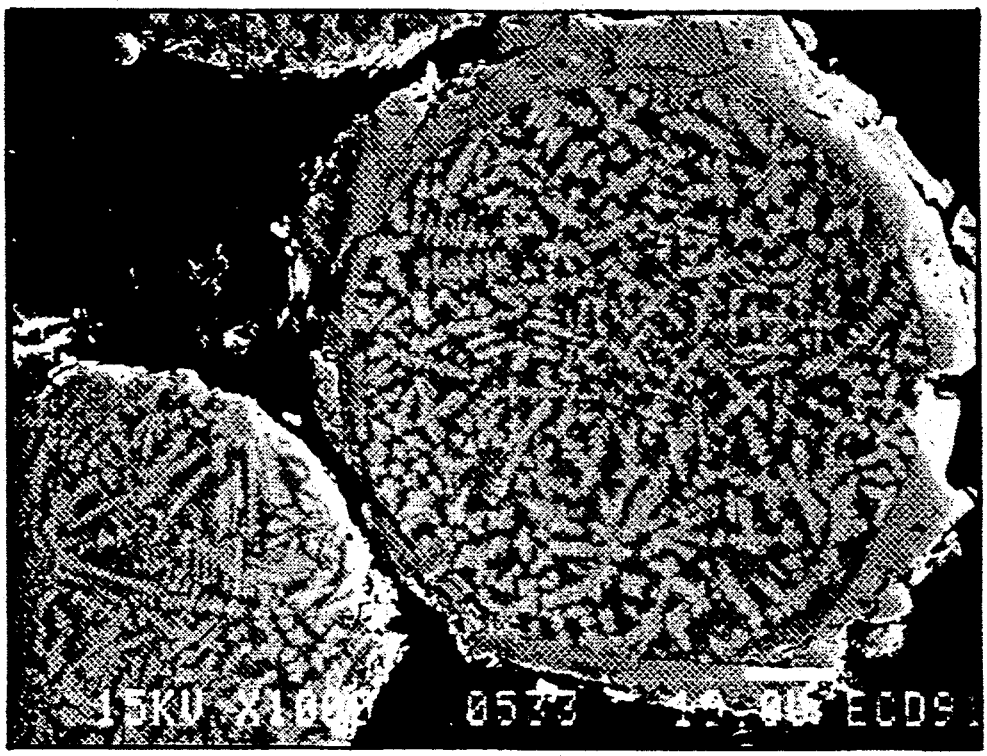
FIG. 1 is a photograph taken through a scanning electron microscope of cross-sectioned and etched particles of one example of the thermal sprayable alloy powder of this invention.

As described, the improved coating alloy powder of this invention is preferably in the form of a thermal sprayable alloy powder. The alloy powder may, for example, be applied by a conventional plasma spray gun, in which case the powder size should be about −70 mesh+325 microns, or by HVOF application guns, in which case the powder may be, for example, −44 mesh+10 microns. The alloy powder of this invention may be formed by conventional atomization processes, including air or water atomization or atomization processes using various inert gases. The fact that the alloy powder of this invention may be formed by conventional atomization processes, yet forms an improved abrasion resistant coating using conventional thermal spray equipment is an important advantage. As described, the prior art utilizes a blend of molybdenum powder and nickel powder, which is applied by plasma spraying.

The thermal sprayable molybdenum-iron alloy powder of this invention is thus formulated to permit atomization at melting temperatures for conventional atomization processes, as is well known in the art. As described, certain constituents are thus included in the preferred embodiment of the alloy powder of this invention to aid in forming the alloy powder. The thermal sprayed coating formed with the improved alloy powder of this invention results in an improved coating, preferably having improved oxidation and corrosion resistance, good thermal conductivity and improved wear resistance.

It is believed that certain of these advantages result from the two distinct molybdenum phases formed in the alloy powder and the resultant coating. As described, the alloy powder of this invention was found to exhibit two distinct and dispersed solid solution phases of molybdenum, including a high concentration molybdenum phase dispersed throughout a lower molybdenum concentration matrix phase. It was found that the higher concentration molybdenum phase has greater than about 40% by weight molybdenum, or more preferably about 50–65% molybdenum, and the lower concentration molybdenum phase has less than about 20% molybdenum, or about 10 to 20% by weight molybdenum. Conversely, the iron in the low molybdenum phase is greater than about 40% by weight and less than about 25% by weight iron in the high molybdenum phase. Each of the solid solution molybdenum phase further includes in the preferred embodiments chromium, nickel, silicon, boron and carbon in proportion to the concentrations of molybdenum in the phase.

The thermal sprayable molybdenum-iron alloy powder of this invention has the following general composition:

| Constituents | Wt. % |
|---|---|
| Mo | 15–60 |
| Cr | 0–20 |
| Ni | 0–20 |
| C | 0–4 |
| Ti | 0–3 |
| Mn | 0–5 |
| Si | 0–3 |
| B | 0–3 |
| Fe | 20–60 |

More preferred compositions, where corrosion and oxidation resistance are desired, will additionally include nickel and chromium, wherein the concentration of nickel plus chromium is 3–35% by weight or more preferably 5–30% by weight. Nickel and chromium enhance the corrosion resistance of the resultant coating without adversely affecting the improved thermal conductivity or wear resistance of the coating. The preferred thermal sprayable alloy powder of this invention further includes carbon, which improves wear resistance and provides additional hardness.

A more preferred embodiment of the thermal sprayable molybdenum-iron alloy powder of this invention comprises the following composition:

| Constituents | Wt. % |
|---|---|
| Mo | 20–55 |
| Cr | 3–20 |
| Ni | 2–20 |
| C | 0.5–3 |
| Ti | 0–2 |
| Mn | 0–3 |
| Si | 1–3 |
| B | 0–2 |
| Fe | Balance (20–60%) |

Boron may be added to reduce the melting temperature of the alloy for melting in a conventional atomization process and to reduce oxidation of the resultant coating. Titanium may be added to reduce oxidation during atomization of the alloy powder and manganese may be added to provide improved toughness for the coating. Thus, it will be understood by those skilled in the art, that the improved coating alloy of this invention results in more flexibility to include various additions to the alloy powder to provide improved properties of the coating and to permit formulating the powder for a particular coating application.

For example, the following composition is particularly suitable for forming wear and abrasion resistant coatings on steel or iron substrates having improved thermal conductivity and corrosion resistance, such as yankee dryer rolls:

| Constituents | Wt. % |
|---|---|
| Mo | 25–50 |
| Cr | 4–10 |
| Ni | 10–18 |
| C | 1–3 |
| Si | 1–3 |
| B | 0–1 |
| Fe | Balance (25–50%) |

Silicon is added as necessary to increase fluidity and promote atomization of the powder. As will now be understood, however, the molybdenum remains a major constituent of the improved thermal sprayable powder alloy of this invention, but is alloyed with iron to minimize galvanic corrosion. Carbon is added preferably at relatively high levels to enhance the hardness and wear resistance of both iron and molybdenum. Chromium and nickel are included to modify the corrosion resistance of the resultant coating. This formulation of the alloy powder of this invention is thus particularly useful for coatings subject to corrosive atmospheres and which require good wear resistance and thermal conductivity.

Based upon the thermal sprayable alloy powder compositions formed to date, the following composition has been found to be most preferred for forming coating subject to abrasion and corrosive atmospheres, such as the yankee dryer rolls discussed above:

| Constituents | Wt. % |
|---|---|
| Mo | 25–40 |
| Cr | 4–8 |
| Ni | 12–18 |
| C | 1–2.5 |
| Si | 2–3 |
| B | 0.2–1 |
| Fe | 25–50 |

Further, as set forth above, other constituents may be added for particular applications. For example, titanium may be added to reduce oxidation during atomization and manganese may be added to provide improved toughness for the coating. It will be understood by those skilled in the art, however, that further constituents can be added to the thermal sprayable alloy powder of this invention for special applications.

Having described preferred compositions of thermal sprayable alloy powders of this invention, the following examples further highlight the most preferred compositions of the thermal sprayable alloy powder of this invention formulated to form improved wear and abrasion resistant coatings having high thermal conductivity and improved corrosion and oxidation resistance.

Example 1 was a metal alloy formulated to have the following composition in weight percent:

| Constituents | Wt. % |
|---|---|
| Mo | 30.06 |
| Cr | 6.50 |
| Ni | 14.75 |
| C | 2.25 |
| B | 0.49 |
| Si | 2.15 |
| Fe | 43.8 |

FIG. 1 are cross-sectional views of alloy powders formed from the alloy composition of Example 1, above, viewed with a scanning electron microscope with a magnification of 1000. The particle size illustrated is −170 +325 mesh. The powder was formed in a conventional dry atomization tower. The illustrated powder was atomized in an inert atmosphere. The cross-sectioned powder was etched in the normal fashion prior to viewing with the scanning electron microscope.

Figure 3:
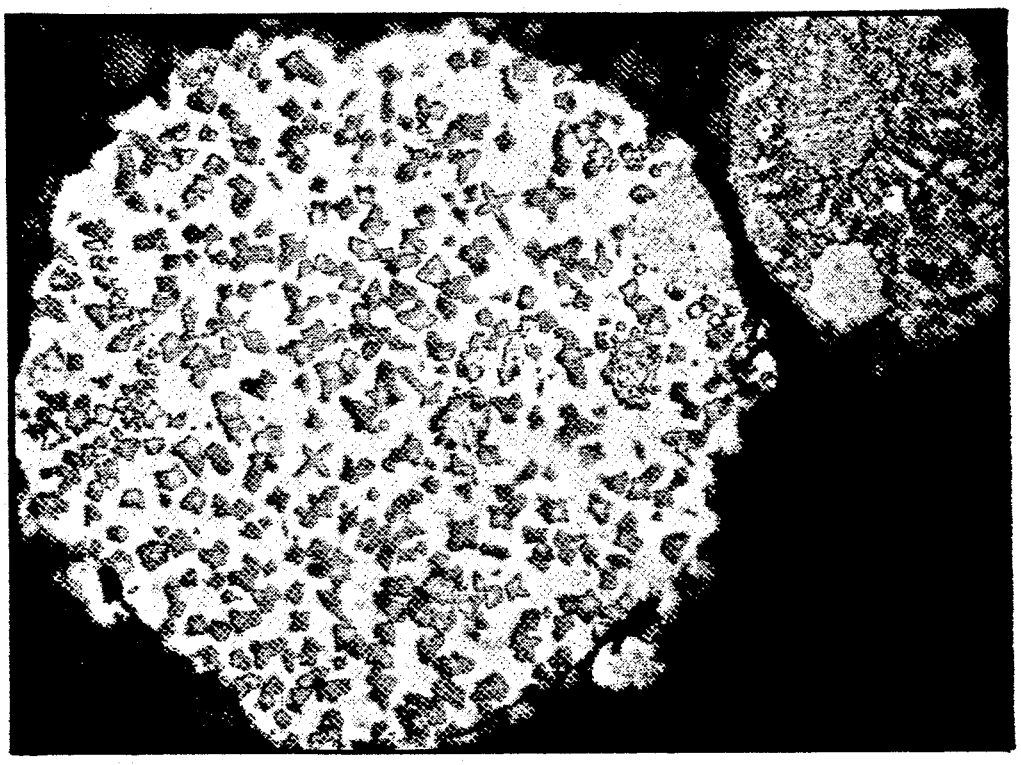
FIG. 3 is a photograph taken through a scanning electron microscope of cross-sectioned and etched particles of a further example of the thermal sprayable powder of this invention having the same composition as the powder illustrated in FIG. 1.
Figure 4:
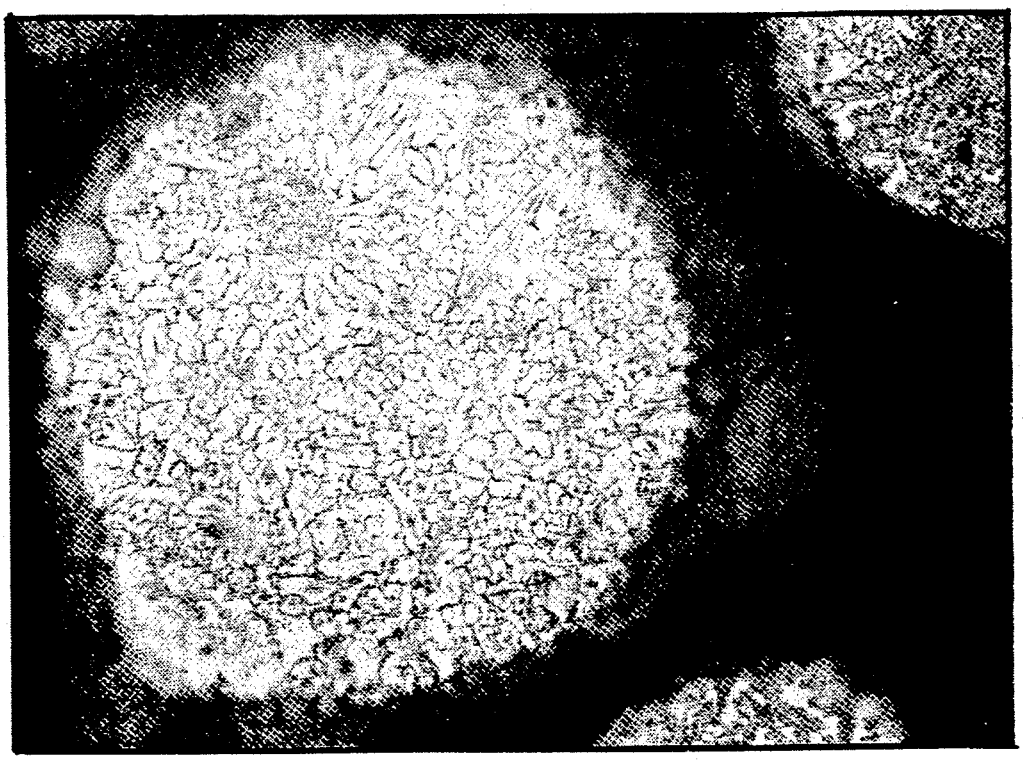
FIG. 4 is a photograph taken through a scanning electron microscope of a further example of the thermal sprayable powder of this invention having the same composition as the powder illustrated in FIG. 2.

FIG. 3 are cross-sectional views of alloy powder formed from the same composition as Example 1, above, wherein the powder was cooled more slowly during the atomization process. Where the powder is cooled rapidly, the secondary phase is dendritic as shown at 2 in FIG. 1. Where the powder is cooled more slowly, the secondary phase in generally more spherical. Both powders (FIGS. 1 and 3), however, clearly illustrate the two-phase morphology of the preferred thermal sprayable alloy powder of this invention, as described more fully herein below.

Example 2 was a metal alloy having the following composition in weight percent:

| Constituents | Wt. % |
|---|---|
| Mo | 38.10 |
| Cr | 5.40 |
| Ni | 16.50 |
| C | 1.60 |
| B | 0.51 |
| Si | 2.33 |
| Fe | 35.56 |

Figure 2:
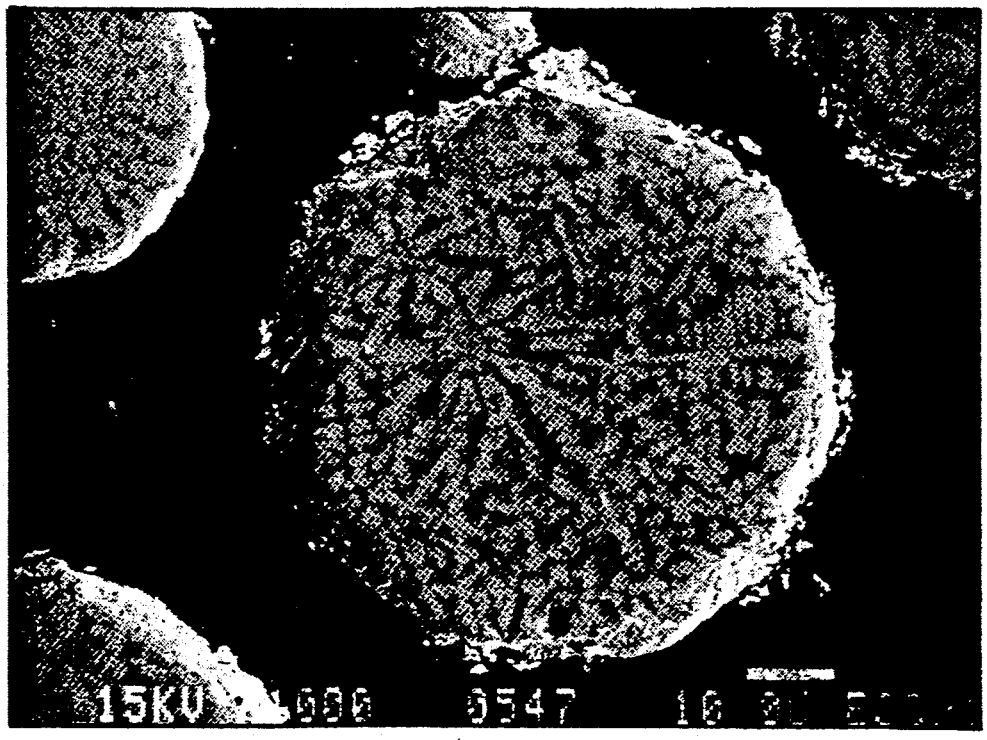
FIG. 2 is a photograph taken through a scanning electron microscope of cross-sectioned and etched particles of a second example of the thermal sprayable powder of this invention.

FIG. 2 illustrates a powder formed from the composition of Example 2 similar to FIG. 1. The powder was cross-sectioned and etched and FIG. 2 is a photograph of the cross-sectioned powder through a scanning electron microscope with a magnification of 1000. As described above, the secondary phase (5) is dendritic.

Figure 5:
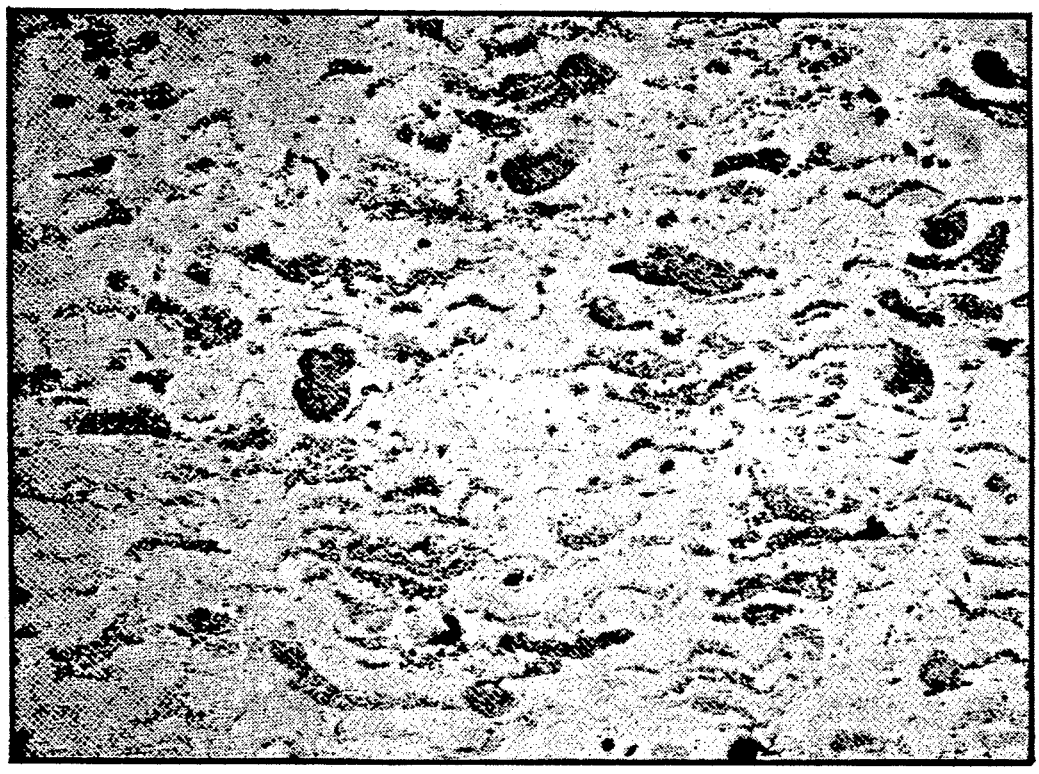
FIG. 5 is a photograph taken through a scanning electron microscope of a coating which has been polished and etched formed by thermal spraying a powder having the composition of the powders illustrated in FIGS. 2 and 4.

FIG. 3 illustrates a powder formed from the alloy composition of Exhibit 2, wherein the powder was cooled at a slower rate as discussed above in regard to FIG. 3. FIGS. 3 and 5 were viewed with a scanning electron microscope magnified 1000 times.

Using Kevex 7077 system, an energy dispersion x-ray spectrometry (EDS) analysis of the two-phase composition of the alloy powders illustrated in FIGS. 1-4 was made to determine the composition of the phases. The EDS analysis of the lower molybdenum concentration matrix phase illustrated at 1 in FIG. 1 was as follows:

| Constituents | Wt. % |
|---|---|
| Mo | 11.88 |
| Cr | 8.10 |
| Ni | 19.48 |
| Si | 1.06 |
| Fe | 59.49 |

It will be understood that the concentration of boron and carbon cannot be determined by conventional EDS analyses and thus the listed concentrations of molybdenum, chromium, nickel, silicon and iron are relative to each other. However, the total concentration of the carbon and boron in Example 1 was less than 3% and thus the actual concentration of the measured constituents can be reasonably accurately determined. Thus, it was found that the concentration of molybdenum in the low molybdenum concentration matrix phase was about 11.5% and the concentration of iron in this phase was nearly 60%. The composition of the secondary or high molybdenum concentration phase at 2 in FIG. 1 was determined by EDS analysis, as follows:

| Constituents | Wt. % |
|---|---|
| Mo | 51.45 |
| Cr | 7.21 |
| Ni | 11.49 |
| Si | 5.22 |
| Fe | 24.63 |

The composition of the phases of the two-phase powder illustrated in FIG. 2 was also analyzed by EDS analysis. The low concentration molybdenum matrix phase illustrated at 4 was found to have the following composition:

| Constituents | Wt. % |
|---|---|
| Mo | 16.77 |
| Cr | 6.34 |
| Ni | 26.14 |
| Si | 1.65 |
| Fe | 49.11 |

Finally, the high molybdenum concentration secondary phase illustrated at 5 in FIG. 2 was found to have the following composition by EDS analysis:

| Constituents | Wt. % |
|---|---|
| Mo | 57.33 |
| Cr | 4.59 |
| Ni | 12.83 |
| Si | 5.36 |
| Fe | 19.89 |

The alloy powders illustrated in FIGS. 1-4 were utilized to form excellent coatings using conventional thermal spray apparatus. FIG. 5 illustrates a coating formed using a plasma thermal spray gun commercially available from Sulzer Plasma Technique of Troy, Mich. The coating was polished, etched and FIG. 5 is a photograph taken through a scanning electron microscope magnified 100 times. As shown, the resultant coating exhibits a two-phase morphology; however, the matrix phase comprises the substantial majority of the coating. As set forth above, the particles of the two phased powder exposed to high temperature melt fully and quench harden during the spray process. These particles form a solid solution of all of the constituents, which constitutes the majority of the coating. Other particles, however, deposit on the substrate with the two phases of the powder substantially intact, as illustrated at 6 in the photograph of Exhibit 5. FIG. 5 was formed using a thermal sprayable powder having the composition of Example 2, above. However, a coating formed using the powder of Example 1 appears very similar. A coating formed with the alloy metal composition of Example 1 had a hardness of Rockwell C 50-58 and a coating formed with the alloy of Example 2 had a hardness of Rockwell C 45-52. Thus, the resultant coating would have good abrasion resistance. As described above, nickel and chromium enhances the corrosion resistance of the coating, without adversely affecting the improved thermal conductivity or wear resistance.

Thus, the thermal sprayable alloy powder of this invention exhibits unique properties and may be utilized to form an improved wear and corrosion resistant coating.

Having described the preferred composition of the thermal sprayable alloy powder and coatings of this invention, the invention is now claimed, as follows:

1. A thermal sprayable molybdenum-iron alloy powder having an average particle size of less than about 80 mesh, said alloy powder having the following composition in weight percent:

| | |
|---|---|
| Mo | 25–50 |
| Cr | 4–10 |
| Ni | 10–18 |
| C | 1–2.5 |
| Si | 2–3 |
| B | 0.2–1 |
| Ti | 0–2 |
| Mn | 0–3 |
| Fe | 25–50. |

2. A thermal sprayable molybdenum-iron alloy powder having generally the following composition, in weight percent:

| | |
|---|---|
| Mo | 30. |
| Cr | 6.5 |
| Ni | 14.75 |
| C | 2.25 |
| Si | 2.15 |
| B | 0.5 |

wherein the balance is primarily iron.

3. A thermal sprayable molybdenum-iron powder having the following general composition, in weight percent:

| | |
|---|---|
| Mo | 38. |
| Cr | 5.5 |
| Ni | 16.5 |
| C | 1.5 |
| Si | 2.55 |
| B | 0.5 |

with the remainder being primarily iron.

4. A thermal sprayable molybdenum-iron powder wherein said powder comprises particles having two distinct solid solution phases of molybdenum, including a first high molybdenum concentration phase having at least about 40% by weight molybdenum and a second low molybdenum concentration phase having less than about 20% by weight molybdenum, said alloy powder having less than about 20% by weight molybdenum, said alloy powder having an overall composition including 15–60% by weight molybdenum, 30–60% by weight iron and 5–35% by weight nickel plus chromium, said alloy powder having an average particulate size of less than about 80 mesh and wherein said alloy powder has the following overall composition, in weight percent:

| | |
|---|---|
| Mo | 20–55 |
| Cr | 3–20 |
| Ni | 2–20 |
| C | 0.5–3 |
| B | 0–2 |

-continued

| | |
|---|---|
| Ti | 0–2 |
| Mn | 0–3 |
| Si | 0–3 |

with the balance being primarily iron.

5. The thermal sprayable molybdenum-iron alloy defined in claim 4, wherein said alloy powder has the following overall composition, in weight percent:

| | |
|---|---|
| Mo | 25–50 |
| Cr | 4–10 |
| Ni | 10–18 |
| C | 1–3 |
| B | 0–1 |
| Ti | 0–2 |
| Mn | 0–3 |
| Si | 0–3 |

with the balance being primarily iron.

6. A thermal sprayable molybdenum-iron alloy powder having the following composition, in weight percent:

| | |
|---|---|
| Mo | 20–55 |
| Cr | 3–20 |
| Ni | 2–20 |
| C | 0.5–3 |
| B | 0–2 |
| Ti | 0–2 |
| Mn | 0–3 |
| Si | 0–3 |

with the remainder being primarily iron, wherein said alloy powder includes two distinct solid solution phases of molybdenum, including a first low molybdenum concentration matrix phase and a second substantially uniformly dispersed higher molybdenum concentration phase, each of said phases comprising a solid solution of at least molybdenum, chromium, nickel, boron, carbon and iron.

7. The thermal sprayable molybdenum-iron alloy powder defined in claim 6, characterized in that said alloy powder has the following composition, in weight percent:

| | |
|---|---|
| Mo | 25–50 |
| Cr | 4–10 |
| Ni | 10–18 |
| C | 1–3 |
| B | 0–1 |
| Ti | 0–2 |
| Mn | 0–3 |
| Si | 0–3 |

with the balance being primarily iron.

8. The thermal sprayable molybdenum-iron alloy defined in claim 7, characterized in that said first lower molybdenum concentration matrix phase includes less than about 20% by weight molybdenum and said second high molybdenum concentration phase includes at least about 40% by weight molybdenum.

9. The thermal sprayable molybdenum-iron alloy powder defined in claim 8, characterized in that said high molybdenum concentration phase includes about 50–60% by weight molybdenum and said lower molybdenum concentration phase includes about 10–20% by weight molybdenum.

* * * * *